US006068726A

United States Patent [19]

Pohjola

[11] Patent Number: 6,068,726

[45] Date of Patent: May 30, 2000

[54] APPLYING TILES TO A TILING TABLE

[76] Inventor: Tapio Pohjola, Viherniemenkatu 9 A 9, Fin-00530 Helsinki, Finland

[21] Appl. No.: 09/068,519

[22] PCT Filed: Nov. 10, 1995

[86] PCT No.: PCT/FI95/00618

§ 371 Date: May 11, 1998

§ 102(e) Date: May 11, 1998

[87] PCT Pub. No.: WO97/17512

PCT Pub. Date: May 15, 1997

[51] Int. Cl.[7] ..... E04F 13/08

[52] U.S. Cl. ..... 156/305; 52/390; 264/277; 264/278

[58] Field of Search ..... 156/305; 52/389, 52/390, 391; 264/277, 278

[56] References Cited

U.S. PATENT DOCUMENTS

| | | | |
|---|---|---|---|
| 1,968,189 | 7/1934 | Bartels | 52/289 |
| 3,658,621 | 4/1972 | Jackson | 156/295 |
| 3,982,876 | 9/1976 | Eisenbach | 425/501 |
| 4,257,834 | 3/1981 | Iida et al. | 156/305 |
| 4,832,995 | 5/1989 | McLauchlin | 156/269 |

*Primary Examiner*—Daniel Stemmer
*Attorney, Agent, or Firm*—Larson & Taylor

[57] ABSTRACT

A method of tiling a plane surface using a tiling table, after which the tiling is shifted over to the finishing stage. In the table by means of several perforated lines positioning guides for each tile are formed by fixing stoppers into the holes of said perforated lines, whereupon the tiling apparatus including tile packs is moved over the table. The tiles fall off each in its turn from the apparatus and take their position determined by the stoppers.

12 Claims, 2 Drawing Sheets

APPLYING TILES TO A TILING TABLE

The invention relates to a method of applying tiles to a tiling table.

Previously known from the CH-patent 609 122 is the production of a wall element in placing the tiles in the space between two boards that form the mould. With the tiles properly spaced in the mould, hardening plastic is sprayed into the free back space of the tiles, which binds the tiles into a uniform wall that can be handled and conveyed to the final site.

The disadvantage of such a construction is the great portion of handicraft needed by tile laying. The mould must match the greatest wall or there must be several moulds, i.e one for each wall size. The tiling must cover the mould dimensions exactly so that no binding agent is unnecessarily sprayed on the not-tiled area in the mould.

In order to eliminate the obvious present disadvantages a general solution is brought forth by this invention aiming at automation of tiling and reduction of handicraft.

The most significant advantages of the invention can be considered that tiling of different size plane surfaces is carried out on the same tiling table regardless of the tile size. Tile spacing is made accurately by means of guides rapidly formed on the table for each tile type. Since the guides determine the tile positions, tile laying can be carried out by moving the tiling apparatus over the table. The tiling may be removed from the table by using a vacuum operated suction device adhering to each tile and retaining their position while conveying the tiling to the work station, where the tiles are bonded by spraying binding agent onto the back side. By this method the tiling can be laid on the tiling table also up side down, in which case, binding the tiles with regard to one another can be done on the table taking into account the doorways and the edge cuts if tile spacing does not match the wall dimensions.

In the following the invention is disclosed with reference to the enclosed drawing, where FIG. 1 is a diagrammatic perspective view of the tiling apparatus and tiling table;

Figure 1:
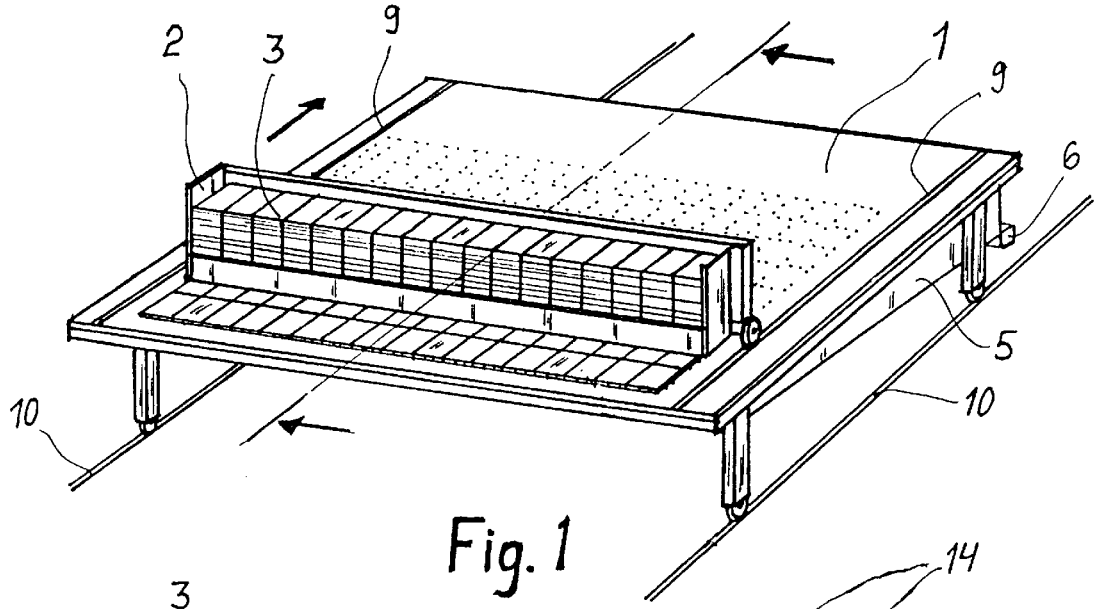

In FIG. 1 the tiling apparatus 2 is arranged to slide along rails 9 on tiling table 1. In addition, table 1 can be moved along rails 10 into different positions, for instance into a position, where the tiling apparatus is lifted off the table. The tiling apparatus 2 moves accurately along rails 9 conveying the tile packs 3 in its rear, from where the nethermost tiles always remain on the table, while the apparatus is moved forward. The tiles stop in proper positions on the table guided by protruding stoppers 7. The stoppers 7 are set exactly on the spacing required by tiles 14 both laterally and longitudinally. For stoppers 7 there are plenty of holes in the table top.

Figure 2:
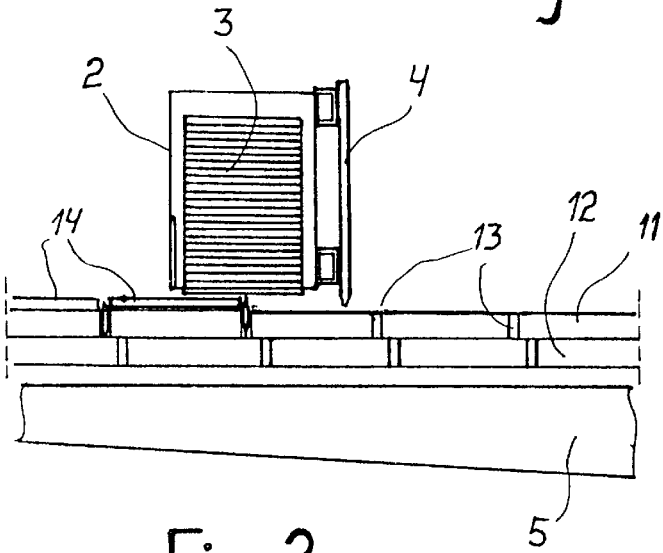
FIG. 2 is a diagrammatic side elevation sectional view of a portion of the apparatus of FIG. 1.
Figure 5:
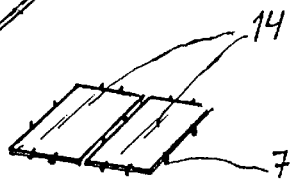
FIG. 5 is a diagrammatic view showing two tiles positioned by stoppers.
Figure 3:
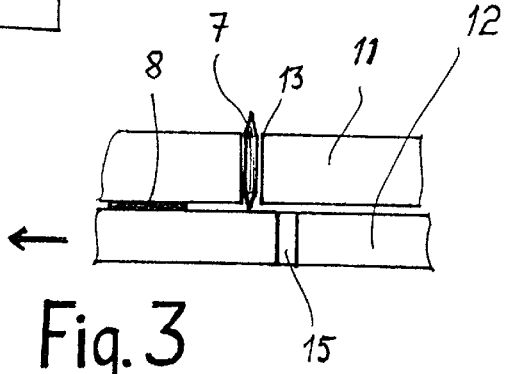
FIG. 3 is a diagrammatic view of a detail of the apparatus of FIG. 1 showing a stopper in the table top.

FIG. 2 shows the tiling apparatus in profile and viewed from the end. In the figure the tile pack 3 is illustrated, from which the nethermost tile 14 has stopped on the table retained by stopper 7 and the next one will stay behind the former one. At first, from stopper supply tube 4 stopper 7 falls into hole 13 when the tube 4 end hits the hole. In this way installation of the stopper and tile laying can be carried out simultaneously with the apparatus. In the lower edge of the rear end of the apparatus there is a stop plate allowing only the nethermost tile to be left on the table. There is in front of the apparatus a sufficient number of supply tubes 4 for stoppers 7 adjusted for the perforated lines of holes 13 in which the stoppers are needed. FIG. 3 shows an enlargement of stopper 7, its respective hole 13 in table top 11 and of the perforated plate 12 under top plate 11 that can be positioned to block each hole 13. Between table top 11 and plate 12 there is a sliding part 8 facilitating the mutual moving of plates 11 and 12 for removal of the stoppers upon need. On moving the top plate and lower plate so that holes 15 of the lower plate 12, which have similar spacing, match the holes of the table top, the stoppers fall down onto base 5, which is inclined from the under side, and further to groove 6. Thus it is easy to remove the stoppers when the tile size changes.

The stoppers can be removed also from the upper side by strong suction or, in case they are made of magnetic material, by a magnet.

Figure 4:
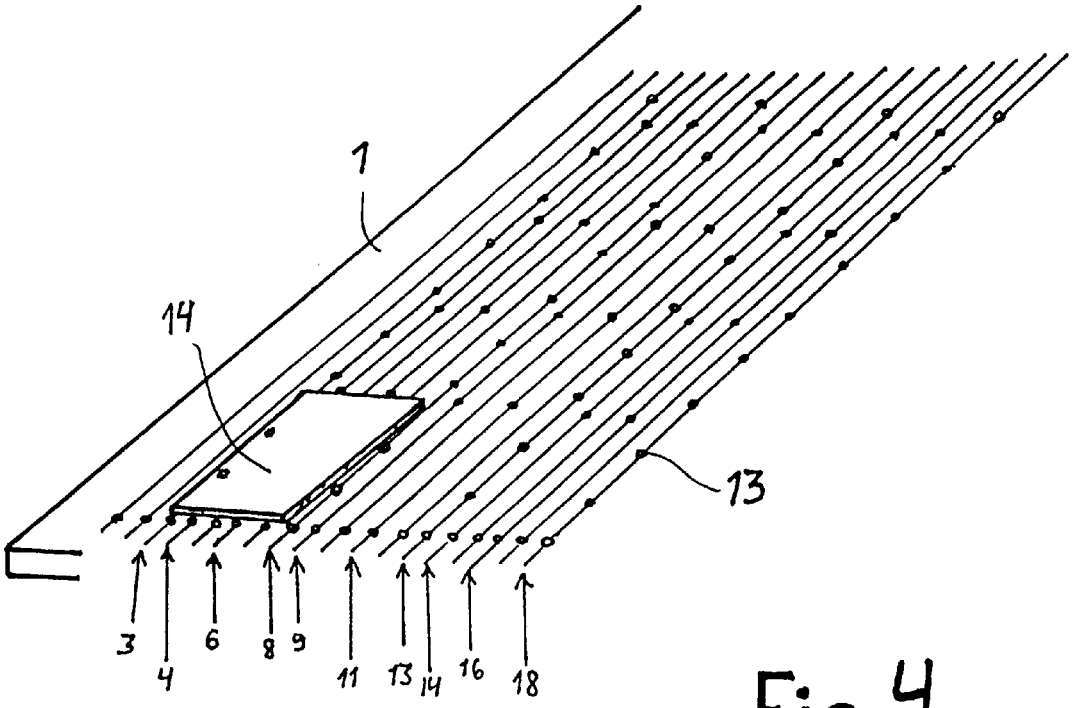
FIG. 4 shows perforated lines in the tiling table of FIG. 1.

FIG. 4 shows perforated lines formed in table 1, among which applicable lines are selected, when working with different tile sizes, into which stoppers are fitted. For the illustrated tile type, perforated lines 3,4,6,8,9,11,13,14,16 and 18 are needed, and the positions of supply tubes 4 of the tiling apparatus are adjusted for each required line. Stoppers 7 fall into holes 13 shown in the figure and then the tiles become separated both laterally and longitudinally by the stoppers.

When different size tiles are laid on the table, the positions of supply tubes 4 must be adjusted for perforated lines matching the respective tile sizes. In the example in the figure a different tile size could use perforated lines 1,2,5, 7,10,12,15 and 17. For the sake of clarity, the holes are not illustrated in these lines. It goes without saying that there is space for many more perforated lines on the table, the space between the tiles as wide as the joint between tiles being sufficient. By way of example, the size of one 100 mm tile can even have more than 24 lines. As to its width (i.e., the dimension transverse to a perforated line), one tile needs only three lines. Thus the guiding holes of eight different tile sizes are easily perforated in the table. In the method the table can be kept immobile and the tiling apparatus moved with regard to the table, or; the tiling apparatus can be kept immobile and the table moved with regard to the tiling apparatus.

The invention is not restricted to the embodiment disclosed herein but many modifications are possible within the limits of the inventional concept. Instead of the stoppers in the form of rods or needles; cross-formed stoppers can be used placed only at the tile junctions so that the cross takes a position where, its prongs are in the perforated line direction and perpendicular to it.

I claim:

1. A method of applying tiles to a tiling table, said tiling table being provided with holes for holding stoppers for positioning tables on the tiling table, said method comprising providing tiling apparatus, said tiling apparatus carrying a plurality of tile packs and carrying a plurality of stopper supply tubes for positioning stoppers in said holes in said table, and moving said tiling apparatus relative to said tiling table above said tiling table whereby, as said tiling apparatus is moved relative to said tiling table, said stoppers enter said holes and said tiles are caused to leave said tiling apparatus sequentially from said tile packs when a tile in a tile pack hits a stopper positioned in a said hole, whereby the tiles are laid on the tiling table in positions determined by said stoppers positioned in said holes.

2. A method according to claim 1 wherein said holes comprise notches in the upper surface of said tiling table.

3. A method according to claim 1 wherein said holes comprise through-holes.

4. A method according to claim 3 wherein said method further comprises removing said stoppers downwardly through said through holes.

5. A method according to claim 4 wherein said through holes are opened by shifting the position of a perforated plate positioned below said tiling table, said perforated plate closing said through holes.

6. A method according to claim 1 wherein said tiling table is kept stationary and said tiling apparatus is moved.

7. A method according to claim 1 wherein said tiling apparatus is kept stationary and said tiling table is moved.

8. A method according to claim 1 wherein the stoppers are arranged and the tiles are laid on the table at the same time while the tiling apparatus is moved relative to the tiling table.

9. A method according to claim 1 wherein said holes are provided on perforated lines which extend in the direction of the relative motion of said tiling apparatus, the and wherein supply tubes are fixed in positions at the front of the tiling apparatus.

10. A method according to claim 9 wherein the supply tubes are positioned in alignment with perforated lines which are selected according to the type of said tiles.

11. A method according to claim 10 further comprising changing the type of tile, and adjusting the position of said supply tubes such that the supply tubes are positioned to move along perforated lines selected for the changed type of tile.

12. A method according to claim 1 wherein each of said stoppers falls out from its supply tube into a hole in said tiling table when the hole and the supply tube are face to face.

* * * * *